US011125535B2

(12) United States Patent
Blish

(10) Patent No.: US 11,125,535 B2
(45) Date of Patent: Sep. 21, 2021

(54) OPTIC TOOL

(71) Applicant: Freddie Blish, Phoenix, AZ (US)

(72) Inventor: Freddie Blish, Phoenix, AZ (US)

( * ) Notice: Subject to any disclaimer, the term of this patent is extended or adjusted under 35 U.S.C. 154(b) by 135 days.

(21) Appl. No.: 14/599,687

(22) Filed: Jan. 19, 2015

(65) Prior Publication Data

US 2015/0204635 A1 Jul. 23, 2015

Related U.S. Application Data

(60) Provisional application No. 61/930,537, filed on Jan. 23, 2014.

(51) Int. Cl.

| | |
|---|---|
| ***F41G 1/54*** | (2006.01) |
| ***F41G 11/00*** | (2006.01) |
| ***B25F 1/00*** | (2006.01) |

(52) U.S. Cl.

CPC ..... *F41G 1/545* (2013.01); *B25F 1/00* (2013.01)

(58) Field of Classification Search

CPC . F41G 1/545; B25F 1/00; B25B 13/48; B25B 13/56

USPC ..... 7/138

See application file for complete search history.

(56) References Cited

U.S. PATENT DOCUMENTS

D130,756 S * 12/1941 Howard ..... 7/138
3,461,469 A * 8/1969 Morrision ..... B25F 1/00 150/132
3,898,723 A * 8/1975 Kirby ..... A63H 18/02 29/270
4,580,469 A * 4/1986 Lordahi ..... B25F 1/00 81/437
D302,514 S * 8/1989 Gates ..... D8/105
5,303,439 A * 4/1994 Seals ..... B25B 13/56 59/7
5,313,860 A * 5/1994 Liou ..... B25F 1/04 7/138
5,588,169 A * 12/1996 Chuang ..... B25B 13/56 7/138
5,652,988 A * 8/1997 Appelhoff ..... B25F 1/00 7/151
5,655,242 A * 8/1997 Chuang ..... B25B 13/04 7/100
D403,227 S * 12/1998 Tseng ..... D8/105
D445,655 S * 7/2001 Maddox ..... D8/105
8,113,094 B1 * 2/2012 Brackbill ..... B25B 15/00 7/138
D703,502 S * 4/2014 Cheng ..... D8/21
8,713,735 B1 * 5/2014 Pelton ..... B26B 11/006 7/138

(Continued)

OTHER PUBLICATIONS

MSW Review; found at http://modernserviceweapons.com/?p=3922, attached as pdf (Year: 2013).*

(Continued)

*Primary Examiner* — Brian D Keller

(74) *Attorney, Agent, or Firm* — Braxton Perrone, PLLC; Bobby W. Braxton; Gregory Perrone

(57) ABSTRACT

An optic tool used for adjusting sights. The optic tool has several features, at least one of which can be used to adjust windage, elevation, and other variables on a sight. The optic tool is a single integrally made piece, which provides decreased manufacturing cost, decreased complexity, and decreased opportunity to malfunction. The option tool has a box wrench, two nubs, and a flat-head.

15 Claims, 1 Drawing Sheet

(56) References Cited

U.S. PATENT DOCUMENTS

| | | | | |
|---|---|---|---|---|
| 2004/0177729 | A1* | 9/2004 | Bell | F16B 23/0069 81/176.15 |
| 2013/0192005 | A1* | 8/2013 | Christenson | B25F 1/006 7/138 |

OTHER PUBLICATIONS

Tamperproof Screw, found at https://web.archive.org/web/20120518002846/http://www.tamperproof.com/categories/snake-eyes-spanner.html, attached as pdf (Year: 2012).*

* cited by examiner

OPTIC TOOL

PRIORITY

This application claims priority to provisional application No. 61/930,537 filed Jan. 23, 2014, the entirety of which is hereby incorporated by reference.

BACKGROUND OF THE INVENTION

Technical Field

The present invention relates to a combat optic tool.

Description of Related Art

Optics devices, including sights, are used by military, law enforcement, and citizen soldiers as well as civilians. These devices need maintenance and adjusting. Consequently, there is a need for a tool which can make the necessary adjustments to such optic devices.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Figure 1:
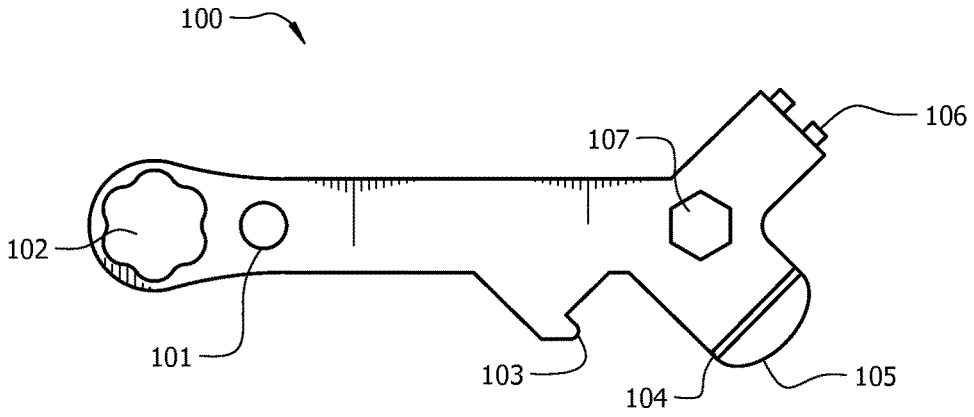
FIG. 1 is a top profile view of an optic tool in one embodiment.

FIG. 1 is a top profile view of an optic tool in one embodiment. As used herein, an optic tool is a tool which is used to adjust optic mounts, such as sights, which are mounted onto a firearm or other weapon. Optic mounts can include virtually any type of sights which help the user aim the weapon. The sights can include, but is not limited to, optic sights, iron sights, red dot sights, laser sights, open sights, reflex sights, telescoping sights, etc. The weapon can include any firearm such as rifle, shotgun, handgun, machine gun, laser guns, etc. The weapon can also include an archer's bow, broad bow, and other hunting devices. As used herein, the term "firearm" will be used to refer to any weapon, including firearms and bows, which shoot a projectile. The optic tool discussed herein, in one embodiment, can be utilized on virtually any type of sight mounted on a weapon.

The optic tool 100, in one embodiment comprises a single piece which functions as a multipurpose tool. This is an advantage over other prior art tools wherein users had to carry a separate tool for each function. Allowing a single tool to perform several operations minimizes the weight that the user must carry, decreases the need to separately store and carry separate tools, and allows the user to manipulate a single tool for multiple purposes. This is ideal when the tool is being utilized in high stress areas such as in combat.

In one embodiment the optic tool 100 comprises a single integrally made piece. As used herein, a single integrally made piece refers to a piece which was made from a single solid material. Thus, for example, a solid blank of metal which is machined and cut, will result in a single integrally made piece. Contrariwise, a screwdriver which combines a plastic handle with a metallic driver, is not an integrally made piece.

There are several advantages to having an optic tool 100 which comprises a single integrally made piece. The first is cost of assembly. It is often cheaper to manufacture a single integrally made piece compared to a complex tool which must be assembled from several distinct parts. Second, tools comprising a single integrally made piece are often more structurally sound that a tool comprising several pieces. Given the high stress environment these tools are used in, it is critical that the tool not malfunction. Having a single integrally made piece reduces the chance the tool will malfunction.

The optic tool 100 can comprise virtually any material. In one embodiment the optic tool 100 comprises 316 stainless steel. In other embodiments, however, the optic tool 100 comprises other metals such as aluminum, titanium, brass, copper, steel alloys and other alloys, etc. Further, the optic tool 100 can comprise a plastic such as PVC, or high density polyurethane.

The optic tool 100 can be used to adjust virtually any variable on many different sights. For example, the optic tool 100, in one embodiment, can adjust the windage and elevation. The optic tool 100 can also be used to adjust gas blocks.

As depicted the optic tool 100 comprises several features. A feature, as used herein, refers to a protrusion, shape, recess or device located on the optic tool 100 which offers functionality to the tool. In one embodiment the optic 100 comprises two or more features.

In one embodiment, and as depicted, the optic tool comprises a hole 101. The hole 101 provides a hole for a key ring or other retention device to be attached. Thus, a user can attach the optic tool 100 to a set of keys, to a strap on a backpack, etc. This helps a user retain and locate the optic tool 100.

As depicted, the optic tool 100 also comprises a box wrench 102. The box wrench can vary in diameter depending on the desired size. In one embodiment the box wrench comprises a diameter of about ⅜ of an inch but this should not be deemed limiting. The box wrench 102 can comprise any desired diameter such as ½ of an inch, ⅛ of an inch, etc. The box wrench 102 allows nuts and bolts to be manipulated, tightened, and loosened as desired. In many mounts, the mounting brackets are bolted on with ½ inch or ⅜ of an inch bolts. In such embodiments, the box wrench 102 can be used to take the mount on and off of the weapon.

As depicted, the optic tool 100 further comprises a protrusion 103 which acts as a bottle opener. The protrusion 103 is sized so as to allow a bottle cap to fit within the recess such that, when torqued, the protrusion 103 opens a bottle.

As depicted in FIG. 1, the optic tool 100 further comprises a flat-head 105. As depicted, the flat-head 105 becomes thinner at the flat-head lip 104. The flat-head 105 can be used like a flat-head screwdriver to manipulate and adjust screws, bolts, etc. In some embodiments, the windage and elevation of the mount are adjusted with the flat-head 105. In some embodiments the gas blocks, or gas regulations systems, are adjusted with the flat-head 105.

As depicted, the optic tool 100 further comprises a hexagon hole 107. The size and diameter of the hexagon hole 107 can be adjusted as desired. In one embodiment, the hexagon hole 107 allows the optic tool 100 to be used as a T-handle wrench for Torx, Hex, and screwdriver bits. Thus, for example, the hexagon hole 107 can be used as a universal bit to receive specific bits, such as a #3 or #3 torque head bits. Thus, the user can carry a multitude of bits, and each of those different bits are compatible and can be used with the hexagon hole 107.

In one embodiment the amount of torque supplied by the features is controlled by adjusting the length of the optic tool 100. Because torque is a function of force and leverage, the length of the optic tool 100 has an effect on the amount of torque applied to a nut, bolt, etc. Many nuts on mounts should be tightened to 60 inch pounds. Accordingly, in one embodiment the optic tool 100 comprises a length such that 60 inch pounds can be applied by at least one of the features. For example, in one embodiment the distance between the center of the hexagon hole 107 and the far end of the optic tool 100 is about 2.75 inches. Such a length is optimized to provide a torque of about 60 inch pounds. In other embodiments the optic tool 100 has a length between about 2 and about 4 inches. In another embodiment the optic tool 100 has a length between about 2.5 and about 3 inches.

As depicted, the optic tool 100 further comprises two nubs 106. A nub, as used herein, refers to a small protrusion which projects outward from the surrounding surface. As depicted, the two nubs comprise small cylindrical protrusions. Some mounts comprise a disk, including a threaded disk, which comprises two cylindrical recesses. The cylindrical nubs 106, in one embodiment, mate with the cylindrical recesses. Accordingly, when the optic tool 100 is rotated, the disk likewise rotates. The nubs 106 can be used in any manner discussed above. In one embodiment, nubs 106 are used to with the Micro Series of optics manufactured by Aimpoint® of Sweeden. In one embodiment the nubs 106 on the optic tool 100 mate with the geometry on the Aimpoint® Micro series such that the sights can be adjusted.

Figure 2:
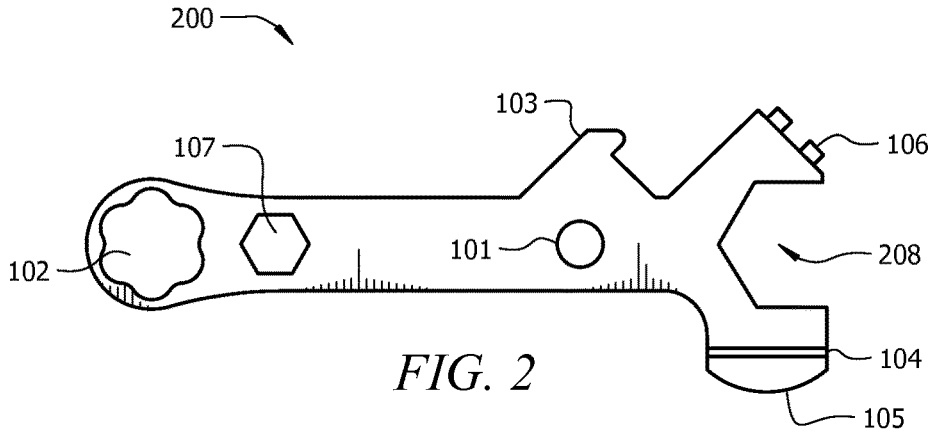
FIG. 2 is a top profile view of an optic tool in one embodiment.

While FIG. 1 depicts the layout of an optic tool 100 in one embodiment, that layout is but one example and should not be deemed limiting. FIG. 2 is a top profile view of an optic tool in an additional embodiment. As can be seen, the hole 101 has been moved to a more central location. Likewise, the hexagon head 107 was moved adjacent to the box wrench 102.

FIG. 2 also comprises an open wrench opening 208. The open wrench opening 208 can comprise any size or diameter. The open wrench opening 208 functions as a wrench and provides an additional function to the optic tool 100.

As depicted, the box wrench 102 and the hexagon hole 107 are on the left side of the optic tool 100. The hole 101, the protrusion 103 acting as a bottle opener, the nubs 106, the open wrench opening 208, and the flat-head 105 are located on the right side of the optic tool 100. As shown, the protrusion 103 and the nubs 106 are located on the top side of the optic tool 100 whereas the flat-head 105 is located on the bottom side of the optic tool 100. The open wrench opening 208 is located at the far right side of the optic tool 100.

Figure 3:
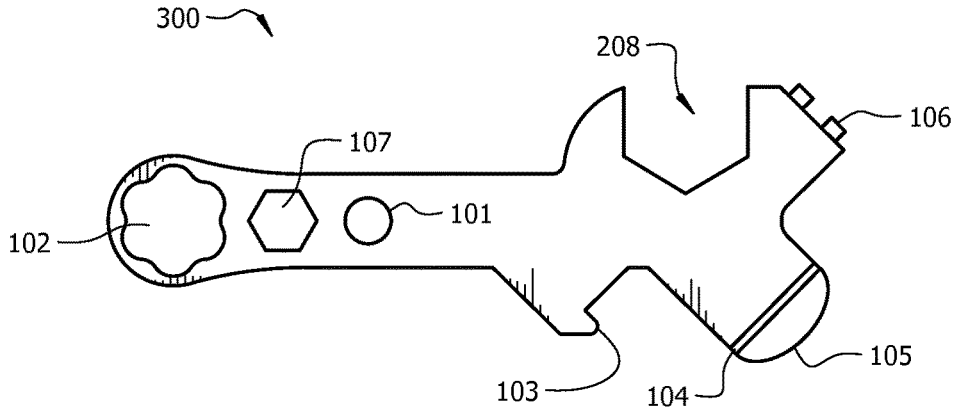
FIG. 3 is a top profile view of an optic tool in one embodiment.

FIG. 3 is a top profile view of an optic tool in yet another embodiment. As shown, the hexagon hole 107, the hole 101, and the box wrench 102 all reside in the left-most portion of the optic tool 100. The protrusion 103, the open wrench opening 208, the nubs 106 and the flat-head 105 are located on the right side of the optic tool. The open wrench opening 208 and the nubs 106 are located on the top side whereas the flat-head 105 and the protrusion 103 are located on the bottom side. Rather than being on the far right end as depicted in FIG. 2, the open wrench opening 208 is shown as being located on the top side of the optic tool 100, adjacent to the nubs 106.

As noted, the optic tool 100 can comprise various lengths, sizes, and thicknesses. In one embodiment the thickness varies from of about 0.1 inches to about 0.2 inches. In one embodiment the optic tool 100 comprises a thickness of about 0.125 inches. Such a thickness is optimized for structural rigidity and strength, as well as compactness.

In one embodiment the optic tool 100 is sized so that it can fit within the firearm's pistol grip. This is a significant advantage as the optic tool 100 can be carried within the firearm. Military and law enforcement personnel must carry a multitude of tools and equipment from the weapon, ammunition, communication devices, first aid kits, protective and safety equipment, etc. Having the ability to store and carry the optic tool 100 on the firearm ensures safe keeping of the optic tool 100 for when it is needed most. In one embodiment the bottom of the handgrip unseats to reveal a small cavity. The optic tool 100 can be stored within that cavity, and the grip can be re-sealed. The optic tool 100 will remain in the cavity of the grip until the user desires to retrieve it. In one embodiment the optic tool 100 is sized to fit within the MagPul MIAD, MOE, and Tango Down Battle Grip.

The optic tool 100 can be used on a wide variety of sights as discussed above. In one embodiment, the optic tool can be used with LaRue Tactical mounts, Aimpoint® mounts, EOTech, Trijicon ACOGS & RMR's, as well as aftermarket mounts such as ADM and GDI.

While the invention has been particularly shown and described with reference to a preferred embodiment, it will be understood by those skilled in the art that various changes in form and detail may be made therein without departing from the spirit and scope of the invention.

ADDITIONAL DESCRIPTION

The following clauses are offered as further description of the disclosed invention.

1. An optic tool comprising:
   two or more features;
   wherein one of said features comprises a box wrench;
   wherein one of said features comprises two nubs;
   wherein one of said features comprises a flat-head;
   wherein said optic tool is a single integrally made.
2. The optic tool of clause 1 wherein one of said features comprise a box wrench.
3. The optic tool of any preceding clause wherein one of said features comprise a bottle opener.
4. The optic tool of any preceding clause wherein one of said features comprises an open wrench opening.
5. The optic tool of any preceding clause comprising stainless steel.
6. The optic tool of any preceding clause wherein said optic tool is less than 3 inches in length.
7. The optic tool of any preceding clause comprising six features.
8. The optic tool of any preceding clause comprising seven features.
9. The optic tool of any preceding clause wherein said optic tool is sized to fit within a Tango Down Battle grip.
10. The optic tool of any preceding clause wherein said at least two nubs are adjacent to said flat-head.
11. The optic tool of any preceding clause wherein said optic tool comprises a solid blank.

12. The optic tool of any preceding clause wherein said flat-head comprises a flat-head lip, and wherein said flat-head is thinner at said flat-head lip when extending outward from said optic tool.

13. The optic tool of any preceding clause comprising a hexagon hole.

14. The optic tool of any preceding clause further comprising a hexagon hole and an open wrench opening.

15. The optic tool of clause 14 wherein said open wrench opening is adjacent to said nubs.

16. The optic tool of clause 14-15 wherein said optic tool comprises a top side and a bottom side, wherein said open wrench opening is on said top side, wherein said flat-head is on said bottom side.

17. The optic tool of clause 14-16 wherein said optic tool comprises a top side and a bottom side, wherein said nuts are located on said top side, and wherein said flat-head is on said bottom side.

18. The optic tool of clause 14-17 wherein said optic tool comprises a left side and a right side, wherein said box wrench is on said left side and wherein said nubs are located on said right side.

What is claimed is:

1. An optic tool comprising:

three or more features;

wherein one of said three or more features comprises a box wrench located on a first distal end;

wherein a second of said three or more features comprises two cylindrical nubs located on a second distal end, wherein said first and second distal ends are on opposite ends of said optic tool;

wherein a third of said three or more features comprises a flat-head located on said second distal end;

wherein said optic tool is a single integrally made tool; and wherein said tool comprises a thickness between 0.1 and 0.2 inches; and wherein said optic tool comprises a hexagon hole.

2. The optic tool of claim 1 wherein one of said three or more features comprise a bottle opener.

3. The optic tool of claim 1 wherein one of said three or more features comprises an open wrench opening.

4. The optic tool of claim 3 wherein said open wrench opening is adjacent to said nubs.

5. The optic tool of claim 1 comprising stainless steel.

6. The optic tool of claim 1 wherein said optic tool is less than 3 inches in length.

7. The optic tool of claim 1 comprising six features.

8. The optic tool of claim 1 comprising seven features.

9. The optic tool of claim 1 wherein said nubs are adjacent to said flat-head.

10. The optic tool of claim 1 wherein said optic tool comprises a solid blank.

11. The optic tool of claim 1 wherein said flat-head comprises a flat-head lip, and wherein said flat-head is thinner at said flat-head lip when extending outward from said optic tool.

12. The optic tool of claim 1 wherein said open wrench opening is adjacent to said nubs.

13. The optic tool of claim 1 wherein said optic tool comprises a top side and a bottom side, wherein said open wrench opening is on said top side, wherein said flat-head is on said bottom side.

14. The optic tool of claim 1 wherein said optic tool comprises a top side and a bottom side, wherein said nubs are located on said top side, and wherein said flat-head is on said bottom side.

15. The optic tool of claim 14 wherein said optic tool comprises a left side and a right side, wherein said box wrench is on said left side and wherein said nubs are located on said right side.

* * * * *